US009316107B2

(12) United States Patent
Megerle et al.

(10) Patent No.: US 9,316,107 B2
(45) Date of Patent: Apr. 19, 2016

(54) STATIC VANE ASSEMBLY FOR AN AXIAL FLOW TURBINE

(71) Applicant: ALSTOM Technology Ltd, Baden (CH)

(72) Inventors: Benjamin Megerle, Wettingen (CH); Ivan William McBean, Bellikon (CH); Timothy Stephen Rice, Rugby (GB); Said Havakechian, Baden (CH)

(73) Assignee: ALSTOM Technology Ltd, Baden (CH)

( * ) Notice: Subject to any disclaimer, the term of this patent is extended or adjusted under 35 U.S.C. 154(b) by 455 days.

(21) Appl. No.: 13/937,635

(22) Filed: Jul. 9, 2013

(65) Prior Publication Data

US 2014/0017071 A1 Jan. 16, 2014

(30) Foreign Application Priority Data

Jul. 11, 2012 (EP) ..... 12176005

(51) Int. Cl.

*F01D 9/02* (2006.01)
*F01D 9/04* (2006.01)
*F01D 5/14* (2006.01)

(52) U.S. Cl.

CPC ..... *F01D 9/041* (2013.01); *F01D 5/142* (2013.01); *F05D 2220/31* (2013.01); *F05D 2220/3215* (2013.01); *F05D 2240/122* (2013.01); *F05D 2260/961* (2013.01)

(58) Field of Classification Search

CPC . F01D 9/041; F01D 5/142; F05D 2220/3215; F05D 2240/122; F05D 2260/961

See application file for complete search history.

(56) References Cited

U.S. PATENT DOCUMENTS

| | | | | | |
|---|---|---|---|---|---|
| 3,442,441 | A * | 5/1969 | Dettmering | F01D 5/142 | 415/181 |
| 3,751,182 | A | 8/1973 | Brown | | |
| 3,804,335 | A * | 4/1974 | Sohre | F01D 1/04 | 239/289 |
| 4,165,616 | A | 8/1979 | Pierpoline | | |
| 4,274,804 | A * | 6/1981 | Teshima | F01D 25/32 | 415/121.2 |
| 7,094,027 | B2 * | 8/2006 | Turner | F01D 5/141 | 415/194 |
| 2004/0126235 | A1 | 7/2004 | Barb et al. | | |
| 2006/0275110 | A1 * | 12/2006 | Baralon | F01D 9/041 | 415/191 |
| 2010/0247310 | A1 | 9/2010 | Kelly et al. | | |
| 2012/0099961 | A1 | 4/2012 | Delvaux et al. | | |

FOREIGN PATENT DOCUMENTS

| | | |
|---|---|---|
| DE | 10 2004 004014 | 8/2005 |
| EP | 1 211 383 | 6/2002 |
| EP | 1 956 247 | 8/2008 |
| EP | 2 463 481 | 6/2012 |
| GB | 2 475 140 | 5/2011 |
| JP | S57-18405 | 1/1982 |
| JP | S61-132704 A | 6/1986 |
| JP | 61-183403 | 11/1986 |

(Continued)

*Primary Examiner* — Ninh H Nguyen

(57) ABSTRACT

An axial flow turbine is described having a casing defining a flow path for a working fluid therein, a rotor co-axial to the casing, a plurality of stages, each including a stationary row of vanes circumferentially mounted on the casing a rotating row blades, circumferentially mounted on the rotor, with within a stage n vanes have an extension such that at least a part of the trailing edge of each of the n vanes reaches into the annular space defined by the trailing edges of the remaining N-n vanes and the leading edges of rotating blades of the same stage.

4 Claims, 4 Drawing Sheets

(56) References Cited

FOREIGN PATENT DOCUMENTS

| | | |
|---|---|---|
| JP | 6-173606 | 6/1994 |
| JP | 2002-266602 | 9/2002 |
| JP | 2004-176723 | 6/2004 |
| JP | 2012-92825 | 5/2012 |

* cited by examiner

STATIC VANE ASSEMBLY FOR AN AXIAL FLOW TURBINE

CROSS-REFERENCE TO RELATED APPLICATIONS

This application claims priority to European Application 12176005.2 filed Jul. 11, 2012 the contents of which is hereby incorporated in its entirety.

TECHNICAL FIELD

This invention relates generally to an assembly of static vanes for axial flow turbines, particularly for low-pressure steam turbines.

BACKGROUND

As described in the U.S. Pat. No. 4,165,616, obtaining highest possible stage efficiencies and avoiding negative reactions on all turbine blades require axial velocities to be maintained within a specific range. Axial velocity of steam exiting a rotatable turbine blade is one of the most significant parameters for determining stage loading, probability of negative reaction, and probability of a turbine stage doing negative work. Last stage or exhaust blades in a turbine are the most difficult blades to optimally design since they are exposed to widely varying pressure ratios due to part load and overload operations.

When exhaust pressures downstream from the exhaust stage vary, last stage blade optimization becomes even more difficult and often results in blades whose peak efficiencies may be rather low. Relatively small variations in exhaust pressure can have a substantial effect on turbine performance. The effect is especially pronounced when the turbine is operating at part load, during startup, or during shutdown where a change in back pressure for any given mass flow rate can cause the exhaust stage's mode of operation to change from zero work to choked flow or vice versa. The normal operation point for turbines is usually designed to fall between the two aforementioned extremes. Operation in the choked flow region would yield no additional turbine power output, but would increase the heat rate of the cycle whereas operation beyond the zero work region would cause consumption of, rather than production of, work generated by the remainder of the turbine blades.

An additional disadvantage to operating beyond the zero work point is that the last stage would eventually experience the unsteady flow phenomenon which can cause extraordinarily large blade vibrations. An additional reason for avoiding operation beyond the choke point is the discontinuous flow patterns which result upstream and downstream from the choke point. Such discontinuous and unsteady flow adds vectorially to any stimulating vibratory force on the blade caused by external forces.

It is generally known to provide shrouds at the tip and/or snubbers at a mid-height point to rotating blades to prevent vibration. The U.S. Pat. No. 3,751,182 describes a form of guide vanes fastened to adjacent rotating blades near the tip of the blades to connect the blades such as to reduce vibrations.

In view of the prior art it is seen as an object of the present invention to provide an arrangement of static vanes, in particular of the static vanes in the last stage blades of a low pressure steam turbine. The arrangement is preferably designed to reduce blade vibrations.

SUMMARY

According to an aspect of the present invention, there is provided an axial flow turbine having a casing defining a flow path for a working fluid therein, a rotor co-axial to the casing, a plurality of stages, each including a stationary row of vanes circumferentially mounted on the casing a rotating row blades, circumferentially mounted on the rotor, where within a stage n vanes have an extension such that at least a part of the trailing edge of each of the n vanes reaches into the annular space defined by the trailing edges of the remaining N-n vanes and the leading edges of rotating blades of the same stage.

The number n of extended vanes is larger than zero but less than half of the total number N of vanes in the stage.

Preferably, the extended part of the vane is located within the two-third of the vane which is closer to the casing.

The above and further aspects of the invention will be apparent from the following detailed description and drawings as listed below.

BRIEF DESCRIPTION OF THE DRAWINGS

Exemplary embodiments of the invention will now be described, with reference to the accompanying drawings, in which.

DETAILED DESCRIPTION

Figure 1A:
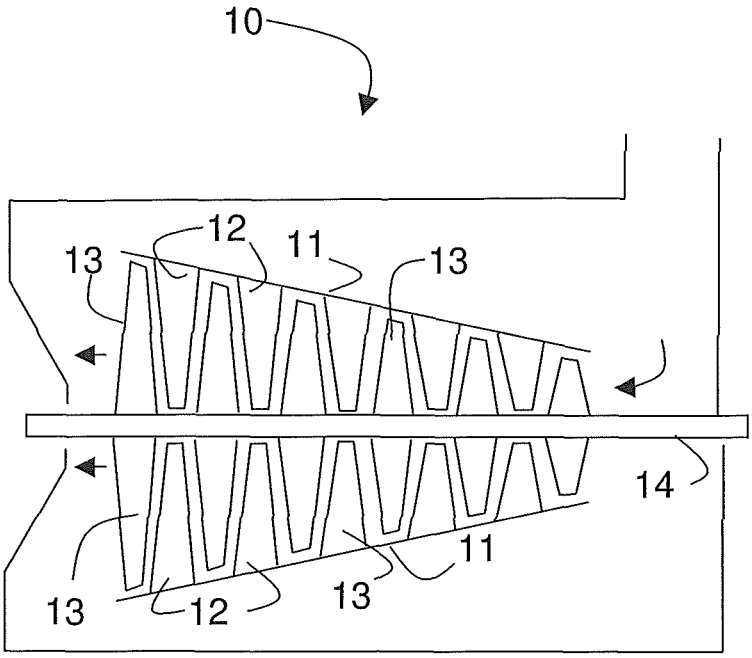
FIG. 1A (Prior Art)
FIG. 1A is a schematic axial cross-section of a turbine.

Aspects and details of examples of the present invention are described in further details in the following description. Exemplary embodiments of the present invention are described with references to the drawings, wherein like reference numerals are used to refer to like elements throughout. In the following description, for purposes of explanation, numerous specific details are set forth to provide a thorough understanding of the invention. However, the present invention may be practiced without these specific details, and is not limited to the exemplary embodiments disclosed herein FIG. 1A shows an exemplary multiple stage axial flow turbine 10. The turbine 10 comprises a casing 11 enclosing stationary vanes 12 that are circumferentially mounted thereon and rotating blades 13 that are circumferentially mounted on a rotor 14 with the rotor resting in bearings (not shown). The casing 11, vanes 12 and blades 13 define a flow path for a working fluid such as steam therein. Each blade 12 has an airfoil extending into the flow path from the rotor 14 to a tip region. The blade 13 can be made of metal, including metal alloys, composites including layered composites that comprise layered carbon fibre bonded by resins or a mixture of both metal and composites. The multiple stages of the turbine 10 are defined as a pair of stationary vane and a moving blade rows wherein the last stage of the turbine 10 is located towards the downstream end of the turbine 10 as defined by the normal flow direction (as indicated by arrows) through the turbine 10. The turbine 10 can be a steam turbine and in particularly a low pressure (LP) steam turbine. As LP turbine, it is followed typically by a condenser unit (not shown), in which the steam condensates.

Figure 1B:
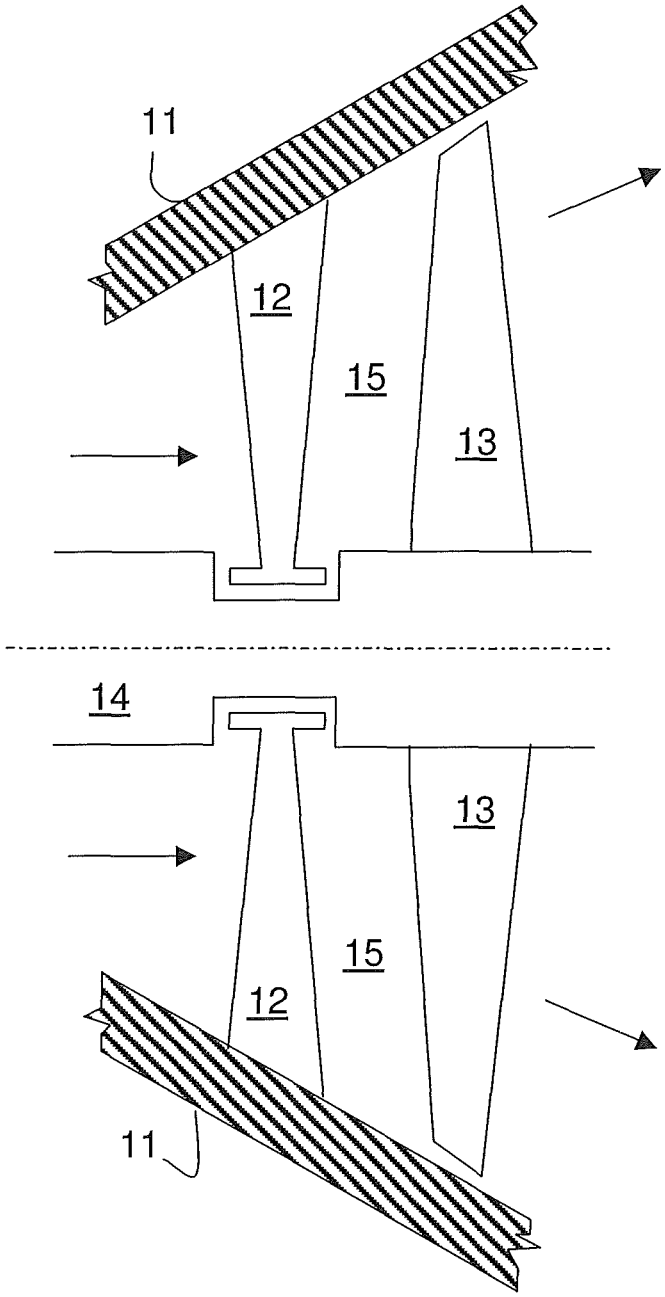
FIG. 1B (Prior Art)
FIG. 1B shows an enlarged view of the last stage of the turbine of FIG. 1A.

The last stage of a conventional turbine 10 with the last row of vanes 12 and blades 13 is shown enlarged in FIG. 1B. In the conventional turbine the vanes or guide blades forming the circumferential assembly of the last stage or in fact any other stage are essentially uniform in shape and dimensions. The trailing edges of the vanes 12 and the leading edges of the blades 13 form the boundaries of an annular space 15 around the rotor 14. The steam travels through this space on its way through the last stage and into the condenser (not shown)

Figure 2A:
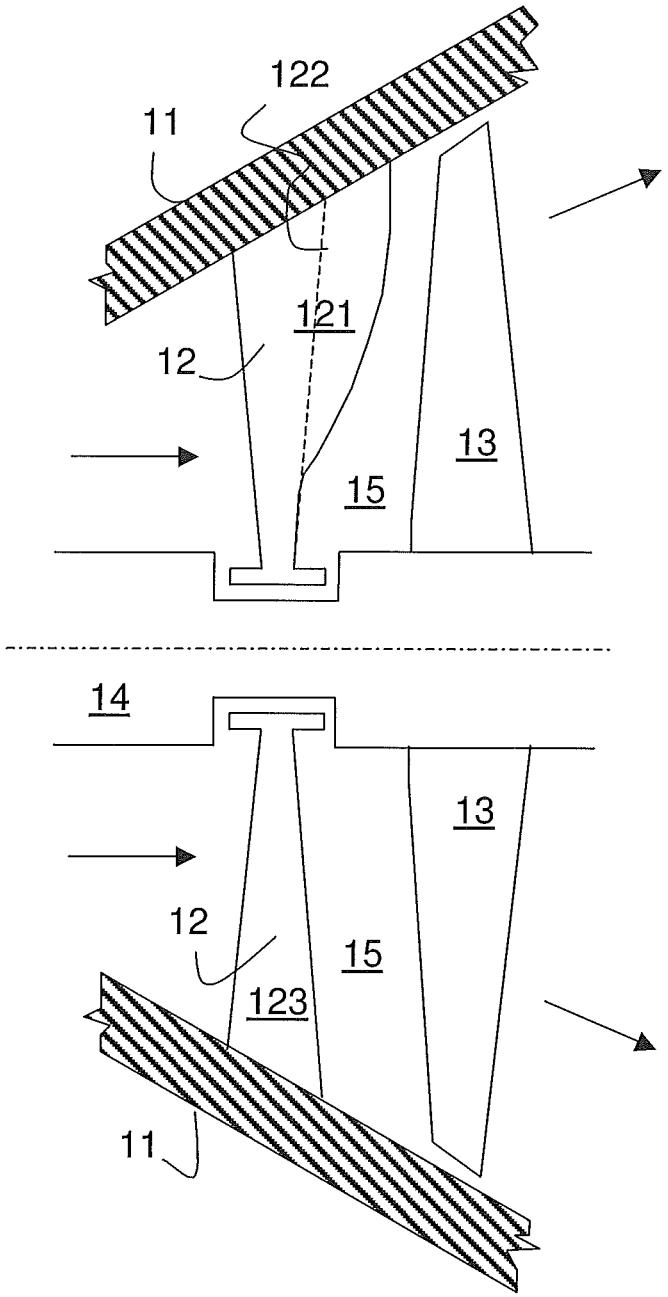
FIG. 2A shows an enlarged view of the last stage of a turbine in accordance with an example of the invention.
Figure 2B:
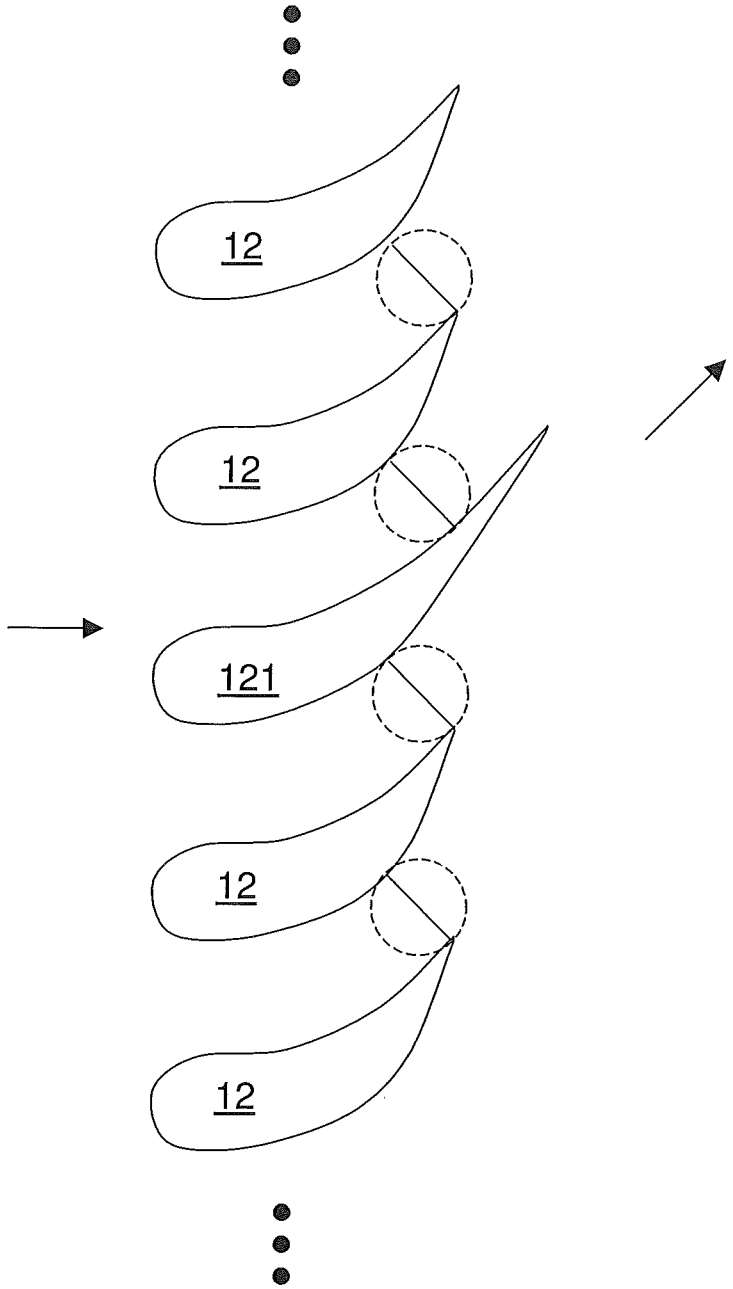
FIG. 2B is a horizontal cross-section at a constant radial height through the vanes of the last stage of a turbine in accordance with an example of the invention.

In an example of the invention as shown in FIGS. 2A and 2B several vanes 12 of the last stage have extended chord length and thus extend further into the space between the vanes 12 and blades 13 of the last stage. Other elements are identical or similar to the elements of FIG. 1B and are denoted with the same numerals.

In FIG. 2A the upper vane 121 is shown having an extended chord length. The length of the normal vanes is indicated with the dashed line 122. Also the lower vane 123 is shown to be vane of normal chord length for the purposed of illustrating this example of the invention. It may however be preferable to distribute the several vanes with extended chord length evenly or symmetrically around the circumference of the stage. The vanes with extended chord length can be distributed either irregularly or evenly or symmetrically around the circumference of the stage.

It is preferable to limit the part of the vane which has an extended chord length to the lower ⅔ of the total vane height leaving the tip of the vanes unchanged. Typically the axial gap between the vanes and the rotating blades needs to be increased towards the casing to reduce erosion, while at the hub or tip of the vane this gap is minimal. A larger axial gap allows the droplets better to separate from the main flow as they are accelerated in tangential direction over a longer distance. Secondly, more droplets are centrifuged out and collected at the casing where they cannot harm the rotating blade. By increasing the chord of just a few vanes, it is found that erosion is only slightly increased but the highly circumferentially directed flow under ventilation conditions between the vanes and the rotating blades is disturbed leading to lower blade vibrations.

A part of the circumferential arrangement is shown in FIG. 2B as a horizontal cross-section through the vanes 12 at a fixed radial distance. Of the five vanes 12 shown, the vane 121 has an extended chord length. Thus at least part of the trailing edge of vane 121 reaches further into the space towards the following blades 13 (not shown). The dashed circles indicate the narrowest passage or throat between the vanes. Although an extended vane 121 is introduced, the throat and throat angle or gauge angle is maintained for all vanes of the stage. The flow along both sides of vane 121 is similar to the flow through the other vanes, thus reducing the losses caused by the introduction of the extended vane 121.

It is worth noting that the introduction of one or more extended vanes amounts to a sub-optimal design of the stage in terms of pure flow parameters. The invention can be seen as being based on the assumption that in certain cases it is advantageous to reduce pure flow efficiency to gain resistance against flow instabilities thereby increasing the operational envelope and/or lifespan of the turbine and its blades.

The insertion of an obstacle into the space between the vanes 12 and blades 13 can reduce blade vibration, potentially by a factor 2 or more. The number of extended vanes in the ring of a stage is best in the range of two to three. The relatively small number of extended vanes is found to be in many cases sufficient to interrupt the blade excitation causing flow pattern between the stages.

The present invention has been described above purely by way of example, and modifications can be made within the scope of the invention, particularly as relating to the ratio of extended vanes over vanes with normal chord length and their spatial distribution along the circumference of the vane ring or diaphragm.

The invention may also comprise any individual features described or implicit herein or shown or implicit in the drawings or any combination of any such features or any generalization of any such features or combination, which extends to equivalents thereof. The breadth and scope of the present invention should not be limited by any of the above-described exemplary embodiments.

Each feature disclosed in the specification, including the drawings, may be replaced by alternative features serving the same, equivalent or similar purposes, unless expressly stated otherwise.

Unless explicitly stated herein, any discussion of the prior art throughout the specification is not an admission that such prior art is widely known or forms part of the common general knowledge in the field.

What is claimed is:

1. An axial flow turbine comprising:

a casing defining a flow path for a working fluid therein;

a rotor co-axial to the casing;

a plurality of stages, each comprising:

a row of N stationary vanes circumferentially mounted on the casing; and a row of rotating blades circumferentially mounted on the rotor, wherein within a stage, n vanes have an extension such that at least a part of the trailing edge of each of the n vanes reaches into the annular space limited by the rotor and the casing and the trailing edges of the remaining N-n vanes and the leading edges of rotating blades of the same stage, wherein the number n of extended vanes is larger than zero but less than half the total number N of vanes in the stage, and the extension is limited to the first ⅔ of the radial height of a vane.

2. The turbine according to claim 1 wherein the stage is a last stage of a low pressure steam turbine.

3. The turbine according to claim 1 wherein the number n is selected to be $0<n<N/4$.

4. The turbine according to claim 3 wherein the number n is selected to be $0<n<4$.

* * * * *